US011646500B2

(12) United States Patent
Glise et al.

(10) Patent No.: US 11,646,500 B2
(45) Date of Patent: May 9, 2023

(54) METHOD FOR INTEGRATING A "NETWORK" ANTENNA INTO A DIFFERENT ELECTROMAGNETIC MEDIUM, AND ASSOCIATED ANTENNA

(71) Applicant: THALES, Courbevoie (FR)

(72) Inventors: Adrien Glise, Elancourt (FR); Isabelle Le Roy-Naneix, Elancourt (FR); Stefan Varault, Elancourt (FR); Grégoire Pillet, Elancourt (FR); Christian Renard, Elancourt (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 17/418,237

(22) PCT Filed: Dec. 18, 2019

(86) PCT No.: PCT/EP2019/086043
§ 371 (c)(1),
(2) Date: Jun. 24, 2021

(87) PCT Pub. No.: WO2020/136059
PCT Pub. Date: Jul. 2, 2020

(65) Prior Publication Data

US 2022/0085515 A1 Mar. 17, 2022

(30) Foreign Application Priority Data

Dec. 28, 2018 (FR) ..... 1874283

(51) Int. Cl.
*H01Q 15/14* (2006.01)
*H01Q 1/52* (2006.01)
(Continued)

(52) U.S. Cl.
CPC ..... *H01Q 15/141* (2013.01); *H01Q 1/528* (2013.01); *H01Q 15/0046* (2013.01); *H01Q 17/001* (2013.01); *H01Q 19/021* (2013.01)

(58) Field of Classification Search
CPC ..... H01Q 1/286; H01Q 1/40; H01Q 1/405; H01Q 1/42; H01Q 1/422; H01Q 1/528;
(Continued)

(56) References Cited

U.S. PATENT DOCUMENTS 4,684,952 A * 8/1987 Munson ..... H01Q 21/065 342/368
6,414,644 B1 7/2002 Desargant et al.
(Continued)

FOREIGN PATENT DOCUMENTS

EP 1928056 A1 * 6/2008 ..... H01Q 15/0046
EP 2175523 A1 * 4/2010 ..... H01Q 13/10
(Continued)

OTHER PUBLICATIONS

D. Headland et al., "Terahertz Reflectarrays and Nonuniform Metasurfaces," in IEEE Journal of Selected Topics in Quantum Electronics, vol. 23, No. 4, pp. 1-18, Jul.-Aug. 2017, Art No. 8500918, doi: 10.1109/JSTQE.2016.2640452. (Year: 2017).*
(Continued)

*Primary Examiner* — Ab Salam Alkassim, Jr.
*Assistant Examiner* — Leah Rosenberg

(57) ABSTRACT

An array antenna (A) in a medium (M) comprises a plurality of radiating elements ($ER_T$) ensuring the transition between the antenna and the medium, the reflectivity of each element depending on a parameter, the reflectivity of a first element being close to that of the medium, the reflectivity of a last element being close to that of the antenna, the reflectivity parameter of the elements varying from one element to the next. A method comprises calculation of a path equal to the
(Continued)

sum of the variations of the reflectivity from one element to the next element, optimization of the variation of the reflectivity parameter so that equivalent radar cross-section of the antenna is the lowest possible or the antenna best observes the radiation objectives, determination of the different elements as a function of said parameter, and simulation of the overall reflectivity and/or of the radiation of the antenna.

24 Claims, 8 Drawing Sheets

(51) Int. Cl.
*H01Q 15/00* (2006.01)
*H01Q 17/00* (2006.01)
*H01Q 19/02* (2006.01)

(58) Field of Classification Search
CPC ..... H01Q 15/0046; H01Q 15/0086; H01Q 15/141; H01Q 17/001; H01Q 19/021; H01Q 19/022; H01Q 21/06; H01Q 21/08; H01Q 15/0013
See application file for complete search history.

(56) References Cited

U.S. PATENT DOCUMENTS 6,937,184 B2 * 8/2005 Fujieda ..... H01Q 1/42 342/198
2002/0101907 A1 * 8/2002 Dent ..... H04B 1/0057 375/132
2007/0006994 A1 1/2007 Liu et al.
2007/0069940 A1 1/2007 Liu et al.
2008/0316124 A1 * 12/2008 Hook ..... H01Q 21/061 343/705
2009/0128393 A1 * 5/2009 Stjernman ..... H01Q 1/287 342/4
2018/0366823 A1 * 12/2018 Liu ..... H01Q 1/42
2021/0194115 A1 * 6/2021 Wintermantel ..... H01Q 1/528

FOREIGN PATENT DOCUMENTS

KR 20100045824 A 5/2010
KR 20100045824 A * 8/2010
WO 2020136059 A 7/2020
WO 20200136059 A1 7/2020

OTHER PUBLICATIONS

E. F. Knott, J. F. Schaeffer and M. T. Tuley, Radar Cross Section, 2nd edition. Scitech Publishing, 2004.
Foreign Communication from a Related Counterpart Application, International Search Report dated Mar. 12, 2020, International Application No. PCT/EP2019/086043 filed on Dec. 18, 2019.
Foreign Communication from a Related Counterpart Application, Written Opinion dated Mar. 12, 2020, International Application No. PCT/EP2019/086043 filed on Dec. 18, 2019.
Jianfeng, Li, et al.: "Amplitude controlled reflectarray using non-uniform FSS reflection plane", Antennas and Propagation (Apsursi), 2011 IEEE International Symposium on, IEEE, Jul. 3, 2011, pp. 2180-2183, XP032191653, DOI: 10.1109/APS.2011.5996945, ISBN: 978-1-4244-9562-7.
Ben A. Munk in his book entitled "Finite Antenna Arrays and FSS", IEEE Press.

* cited by examiner

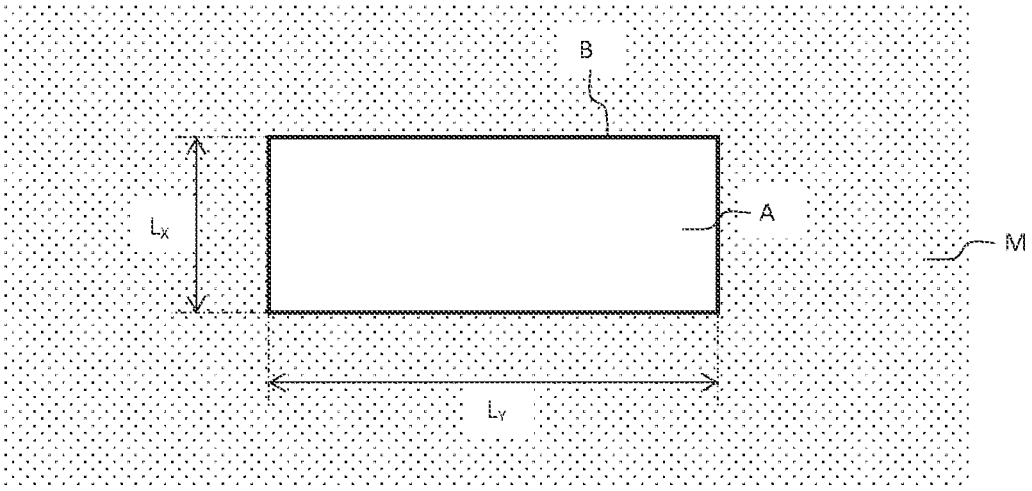
FIG. 1 – PRIOR ART
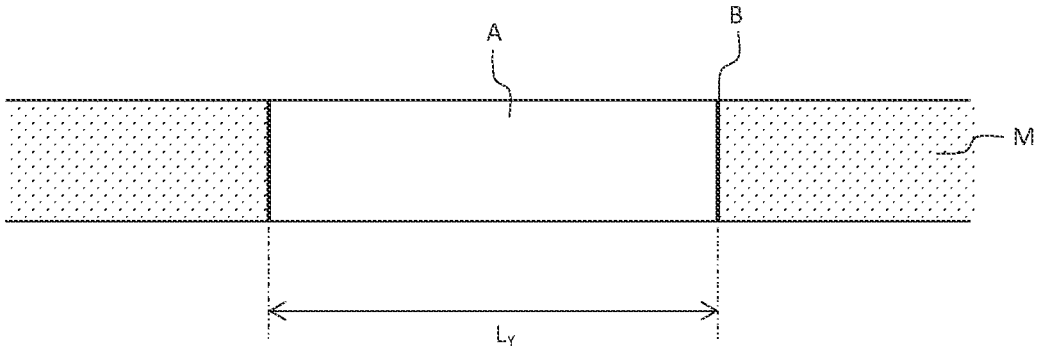
FIG. 2 – PRIOR ART
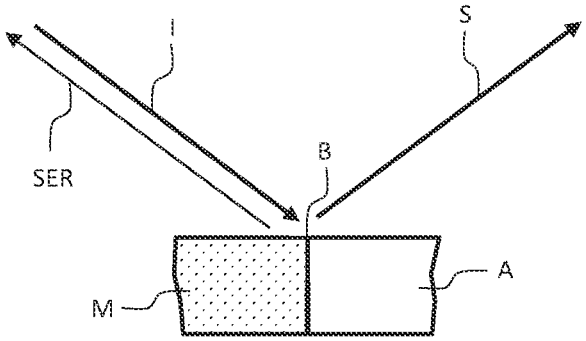
FIG. 3 – PRIOR ART

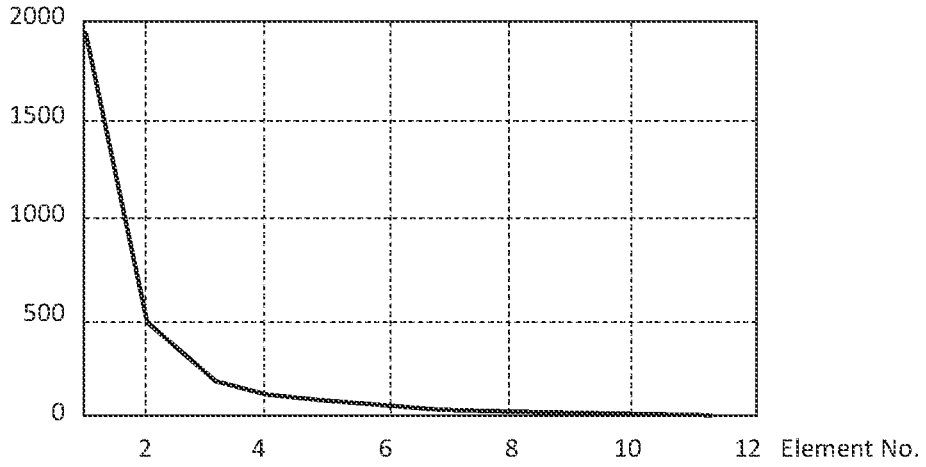
FIG. 11
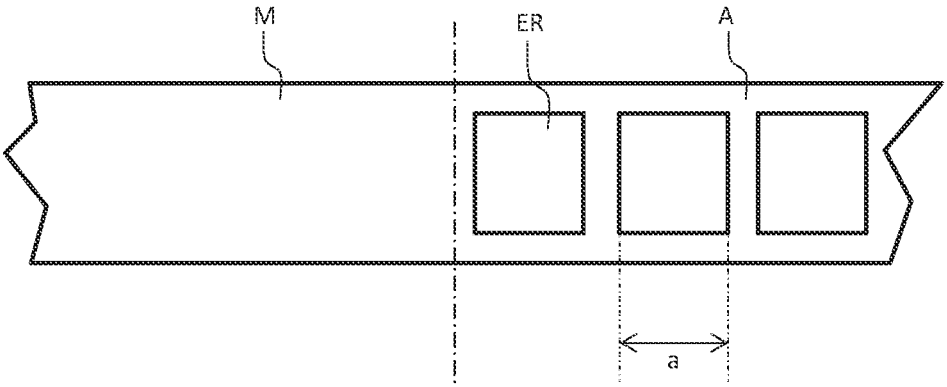
FIG. 12 – PRIOR ART
FIG.13
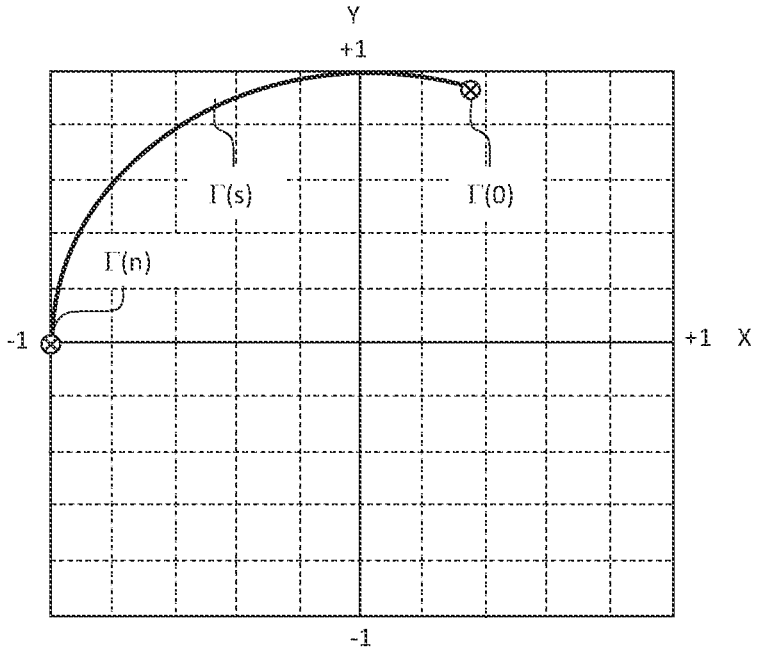

METHOD FOR INTEGRATING A "NETWORK" ANTENNA INTO A DIFFERENT ELECTROMAGNETIC MEDIUM, AND ASSOCIATED ANTENNA

CROSS-REFERENCE TO RELATED APPLICATIONS

None.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

The field of the invention is that of electromagnetic antennas called "array antennas" used in all kinds of radio-communications. These antennas can, notably, be radars. These antennas can be installed on the ground or on any type of mobile carrier, such as aircraft.

The antennas, generally, are incorporated in a medium. That can range from zo a simple pylon for the cellular telecommunication base station to a mobile carrier, such as aircraft. The environment surrounding the antenna has to be taken into account in the design thereof in order not to disrupt the radio frequency performance of the antenna.

Incorporating the antenna on a carrier creates a clean electrical discontinuity which is reflected by a knife-edge diffraction. The diffraction phenomenon disturbs the radiation of the antenna. The knife-edge diffraction also contributes to the electromagnetic signature of the antenna and increases the equivalent radar cross-section, referred to by the French acronym "SER" and the English acronym "ERCS", of the antenna. FIGS. 1 to 3 illustrate this problem by a simple example. FIGS. 1 and 2 represent a top view and a side view of a rectangular antenna A of width $L_x$ and of length $L_y$ incorporated in an environment M of different electromagnetic nature. Thus, the reflectivity Fa of the antenna is different from the reflectivity $\Gamma_m$ of the medium. The black border B in these two figures represents the discontinuity between the antenna and its medium. FIG. 3 represents, by a side view, the reflection of an incident wave I at this discontinuity B. The incident wave I then generates a specular wave S but also a spurious retroreflected wave SER linked to the discontinuity B.

BRIEF SUMMARY OF THE INVENTION

The electromagnetic antennas of array type, commonly called "array antennas", consist of a finite set of radiating elements. Depending on the applications, the construction of a radiating element varies. In some cases, it can consist only of metal. In other cases, it can consist of metal resting on a substrate and surrounded by a superstrate. A superstrate is understood to be any structure which covers the antenna. A radome is a superstrate. This structure can be adapted to change the radiation characteristics of the antenna.

In some conditions, the array antennas can generate surface waves. The surface waves generated by the antenna are diffracted at the border by the edges. These waves can be reflected on the borders of the cavity of the antenna and be diffracted on the other border of the cavity. A phenomenon of multiple reflection of the surface waves is then observed on the cavity borders of the antenna which is reflected by an increase in the SER and a degradation of the performance of the emitted radiation. This phenomenon also contributes to a degradation of the performance of the antenna.

The incorporation of an array antenna comes up against the same type of problem as any antenna. The edges of the border of the panel create diffraction phenomena which mostly disturb the radiating elements situated on the border of the panel and participate in the SER of the antenna.

Different solutions have been proposed to resolve or mitigate these problems of incorporation of the antenna in its medium. First solution consists in adding, in the nearby environment of the antenna materials absorbing the electromagnetic waves; this solution is explained in the publication by E. F. Knott, J. F. Schaeffer and M. T. Tuley, Radar Cross Section, 2nd edition. Scitech Publishing, 2004. This method makes it possible to reduce the cavity reflections and in particular the cavity border reflections due to the presence of surface waves. Moreover, these waves create multiple reflections. The presence of absorbents makes it possible to eliminate this phenomenon of reflection of the surface waves at the borders of the antenna.

In the case of the incorporation of finite array antennas, it is possible to add dummy extra radiating elements with dedicated loads like the radiating elements at the border of the panel in order to reduce diffraction linked to the surface waves, these elements being called loaded radiating elements. This method is described by Ben A. Munk in his book entitled "Finite Antenna Arrays and FSS", IEEE Press. A Wiley-Interscience publication. The reduction of the surface waves contributes to improving the angular capacity for misalignment of the arrays of active antennas and to reducing the SER of the antenna.

A third method is described in the application US 20070069940 entitled "Method and Arrangement for Reducing the Radar Cross Section of Integrated Antennas". It proposes treating the aperture created by the antenna in a medium using resistive materials. This method has the advantage of proposing a soft transition in order to gradually attenuate the surface waves and thus reduce the diffraction due to the border edges.

These different methods each have their drawbacks.

The solutions based on absorbent materials are not generally sufficient. The absorbents often continue to create an abrupt discontinuity between the medium and the antenna. Moreover, the absorbent materials can be of a different nature than the antenna and do not necessarily operate in the same conditions of temperature, pressure or vibratory environment as those of the antenna.

The solution proposed by Ben A. Munk makes it possible to considerably attenuate the surface waves and consists in adding the loaded radiating elements. However, this solution does not resolve the problem of structural diffraction generated by the incorporation of the antenna in its medium. There is still a structural transition between the array antenna and the medium.

The use of progressive resistive layers makes it possible, as an initial approach, to limit the clean discontinuity between the antenna and its medium. However, it addresses only the variation of a single physical parameter, the resistivity of the material, to resolve all of the diffraction problems. Moreover, this method does not address the performance of the antenna, only its incorporation in a metallic medium. Furthermore, this resistive transition is produced on a dielectric material, generally the radome of the antenna.

It is possible that the antenna does not have dielectric layers with the outside medium and therefore makes it impossible to use resistive layers.

These various solutions are not therefore totally satisfactory because they are limited in terms of freedom and make it possible to treat only a limited number of knife-edge discontinuities.

The method according to the invention does not present the above drawbacks. It makes it possible to optimize the transition between the antenna and its medium by addressing the electromagnetic behavior of the discontinuity and thus aims to reduce the effects of diffraction and of surface waves resulting from this transition.

More specifically, the subject of the invention is a method for incorporating an array antenna in a medium, said antenna comprising a plurality of radiating elements ensuring the transition between the antenna and the medium, the reflectivity of each radiating element depending on at least one parameter, the reflectivity being represented by a complex number, the reflectivity of a first element being equal or close to that of the antenna, the reflectivity of a last radiating element being equal or close to that of the medium, the reflectivity parameter of the radiating elements included between this first radiating element and this last radiating element varying from one radiating element to the next, characterized in that the method comprises the following steps:

Step 1: calculation of a path represented in the complex plane and equal to the sum of the variations of the reflectivity from one radiating element to the next radiating element;

Step 2: optimization of the variation of the reflectivity parameter so that the equivalent radar cross-section of the antenna is the lowest possible or that at least one of the characteristics of the radiation of the antenna is reached;

Step 3: determination of the different radiating elements as a function of said parameter;

Step 4: simulation of the overall reflectivity and/or of the radiation of the antenna.

Advantageously, the rate of variation of the parameter is minimal between the first element and the next element, minimal between the last element and the preceding element and maximal between the two elements furthest away from the first element and from the last element.

Advantageously, the reflectivity coefficient is a complex number comprising a real part and an imaginary part and in that the variation of the reflectivity between two radiating elements is equal to the modulus of the variations of the real and imaginary parts of the reflectivity of said radiating elements.

The invention relates also to an array antenna intended to be incorporated in a medium and produced according to the preceding method, said antenna comprising a plurality of radiating elements ensuring the transition between the antenna and the medium, the reflectivity of each radiating element depending on at least one parameter, the reflectivity being represented by a complex number, the reflectivity of a first element being equal or close to that of the antenna, the reflectivity of a last radiating element being equal or close to that of the medium, characterized in that the reflectivity parameter of the radiating elements included between this first radiating element and this last radiating element varies from one radiating element to the next, the rate of variation of the parameter being minimal between the first element and the next element, minimal between the last element and the preceding element and maximal between the two elements furthest away from the first element and from the last element.

Advantageously, the radiating elements being organized in an array, the parameter is the pitch of the array in one direction of the space or two directions of the space.

Advantageously, the radiating elements being metallic, the parameter is a geometrical parameter of the radiating elements so that the radiating elements have different metallic surfaces.

Advantageously, the parameter is a geometrical parameter of the radiating elements so that the radiating elements have different resistive surfaces.

Advantageously, the parameter is a physical characteristic of a substrate constituting the radiating elements.

Advantageously, the parameter is a physical characteristic of a superstrate constituting the radiating elements.

Advantageously, the physical characteristic is the relative permittivity or the permeability of said substrate or of said superstrate.

Advantageously, the radiating elements comprising a plurality of sheets of metallic or resistive patterns, the parameter is the quantity or the arrangement of said sheets present in the radiating elements.

Advantageously, the radiating elements comprising metamaterials, the parameter is the quantity of metamaterials present in the radiating elements.

BRIEF DESCRIPTION OF THE SEVERAL VIEWS OF THE DRAWING(S)

The invention will be better understood and other advantages will become apparent on reading the following description given in a nonlimiting manner, and from the attached figures in which:

FIG. 1 represents, by a top view, a rectangular antenna according to the prior art incorporated in a medium;

FIG. 2 represents, by a side view, the preceding antenna according to the prior art;

FIG. 3 represents the SER (ERCS) generated at the interface between an antenna according to the prior art and a medium;

FIG. 11 represents the variation of the dependency parameter as a function of the succession of the radiating elements;

FIG. 12 represents a top view of a part of an array of radiating elements according to the prior art;

FIG. 13 represents the variation of the complex reflectivity coefficient between two radiating elements in the preceding embodiment;

Figure 4:
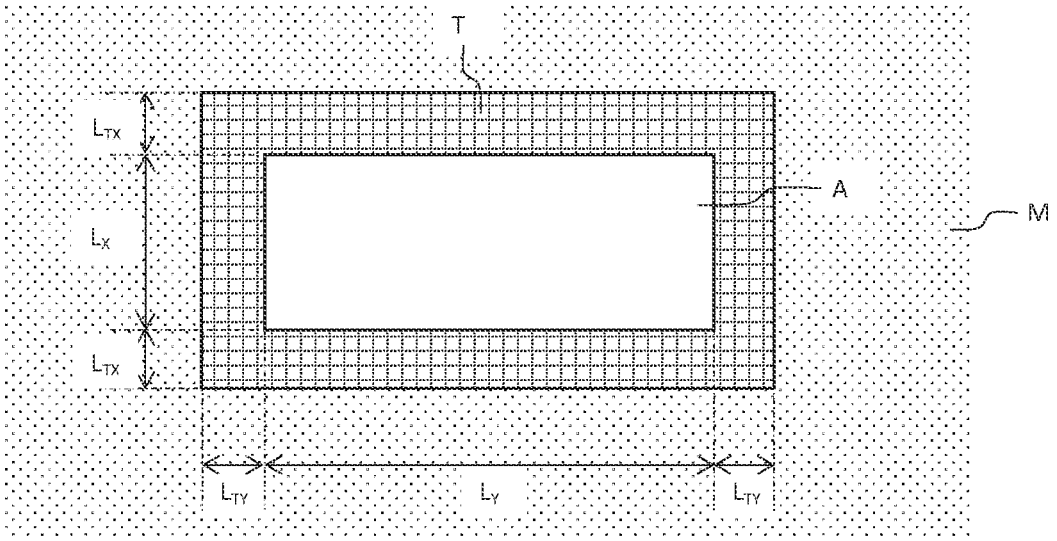
FIG. 4 represents, by a top view, a rectangular antenna according to the invention incorporated in a medium.
Figure 5:
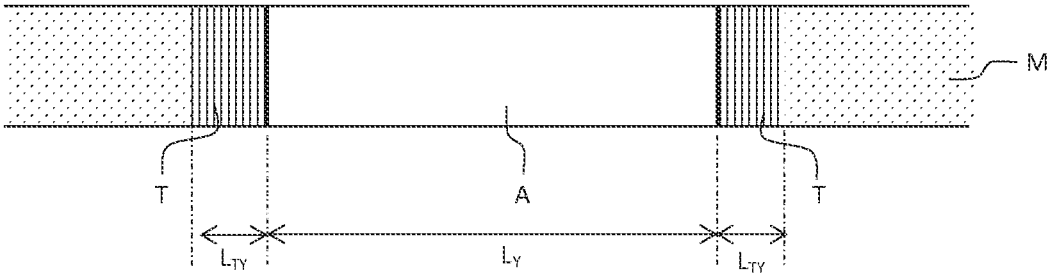
FIG. 5 represents, by a side view, the preceding antenna according to the invention.
Figure 6:
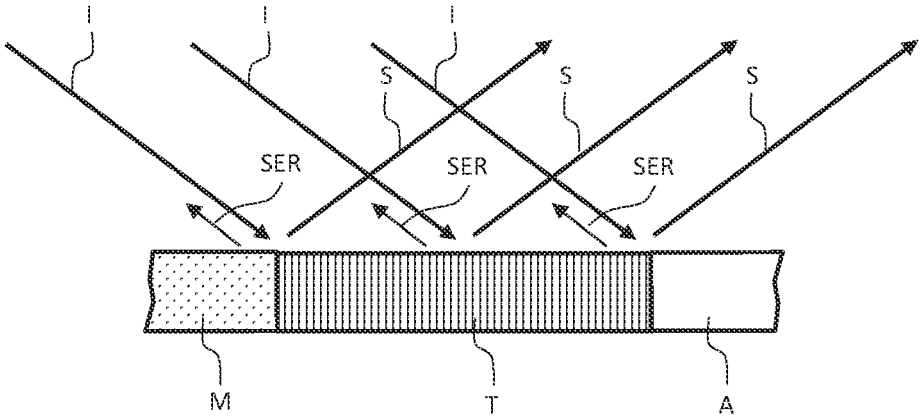
FIG. 6 represents the SER (ERCS) generated at the interface between an antenna according to the invention and a medium.

As an example, FIGS. 4 to 6 represent an antenna A according to the invention incorporated in its environment M. FIGS. 4 and 5 represent a top view and a side view of a rectangular antenna A of width $L_x$ and of length $L_y$ incorporated in an environment M of different electromagnetic nature. As previously, the reflectivity Fa of the antenna is different from the reflectivity $\Gamma_m$ of the medium. This antenna is surrounded by a transition zone T of width $L_{Tx}$ and of length $L_{Ty}$. This transition zone is composed of radiating elements. The electromagnetic parameters of these elements vary so as to modify their reflectivity coefficient $\Gamma_{ij}$, thus ensuring a soft transition between the antenna and its medium.

FIG. 6 represents, by a side view, the reflection of an incident wave I at the transition zone T. The incident waves then generate specular waves S but also retroreflected waves SER of much lower amplitudes than in the absence of transition zone.

DETAILED DESCRIPTION OF THE INVENTION

Generally, the electromagnetic behaviors of the antenna and of the medium are characterized by an impedance or a surface reflectivity. There is a transitional relationship between these two parameters. It is thus possible to model the antenna and its medium by two plates of different impedances.

Generally, the reflectivity is calculated and represented in the complex plane. It depends on the frequency, on the incidence and on the polarization of the wave.

As has been seen, the discontinuity brought about by the change of impedance modifies the radio frequency behavior of the antenna and induces detrimental diffraction phenomena. The incorporation of a progressive and controlled transition of the reflectivity in one or more directions of the space makes it possible to make the effects of this discontinuity disappear. Thus, it is possible to reduce the equivalent radar cross-section in significant proportions. It is also possible to optimize one of the characteristics of the radiation of the antenna. Examples that can be cited are the overall efficiency of the radiation, but also, the form and the distribution of the transmission side lobes or the gain of the antenna.

The progressive variation of the reflectivity from one radiating element to another can be made over one or more physical parameters of the radiating element which can be:

- the pitch of the array in just one or both of the directions of the array;
- an intrinsic geometrical dimension of the radiating element, such as the aperture of a waveguide, a length, a width or a height;
- a physical property of the constituent materials of the radiating element such as, for example, the relative permittivity of the substrate of which it is composed.

To control the progressive variation of the radiating elements at the transition, the reflectivity along the transition can be continuous or discretized. A continuous modification means that the intrinsic property varies in all of the radiating elements of the transition. A discretization of the transition amounts to giving a specific value to each element of the transition. These variations need to make it possible to adequately control the surface reflectivity of each radiating element.

The method according to the invention makes it possible to reduce the effects of diffraction for an incidence, a polarization and a determined frequency. Although the optimization is done for this incidence, this polarization and this determined frequency, it also acts for different incidences, frequencies and polarizations, sometimes according to the same law. Thus, the method is implemented for a typical or average value of the incidence, of the polarization and of the frequency and is applied to a wider incidence, polarization and frequency range.

It should be noted that the reflectivity does not necessarily vary according to these three parameters. For example, the reflectivity of a metallic plane is equal to −1 regardless of the frequency, the polarization and the incidence of the wave.

Take a continuous or discrete assembly of radiating elements linking the antenna and its medium, the first element being in contact with the antenna and the last element being in contact with the medium. The number of radiating elements is denoted n and the order number of a radiating element is denoted i, with i varying from 0 to n.

The reflectivity of this first element is equal or close to that of the antenna, the reflectivity of the last radiating element is equal or close to that of the medium. The reflectivity parameter or parameters of the radiating elements included between this first radiating element and this last radiating element vary from one radiating element to the next.

In a first step of the method according to the invention, as a function of the choice of the physical parameter or parameters, an accessible path L in the behavior between the two extreme radiating elements is defined.

If s represents the variation parameter, s varying between two values that are denoted a and b, each radiating element has the reflectivity r(s).

The latter comprises a real part x and an imaginary part y as indicated below.

$$\begin{cases} x = \mathrm{Re}(\Gamma(s)) \\ y = \mathrm{Im}(\Gamma(s)) \end{cases}$$

The starting point of the path is defined as being the reflectivity of the antenna and the end point is defined as that of the medium. The definition of the reverse also works. The definition of this path gives the variation of the parameterized curve Γ(s).

Figure 7:
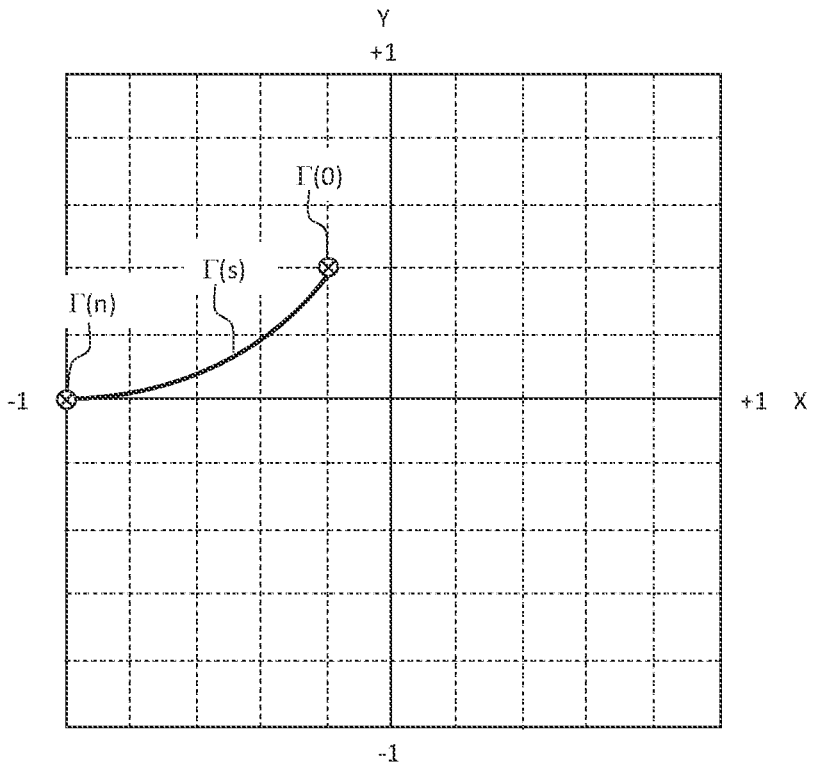
FIG. 7 represents the variation of the complex reflectivity coefficient between two radiating elements according to the invention.

The curve of FIG. 7 gives the complex representation of the accessible path as a function of a single physical parameter. The real part x is on the x axis and the imaginary part y is on the y axis. They lie between −1 and +1.

The definition of a norm is necessary if several parameters are chosen. This norm guarantees the progressive variation of the parameters in order to avoid significant variations of the parameters without in any way detecting it on the curve r(s).

The parameterized curve r(s) is discretized according to a certain number of elements n of the transition, this discretization can be uniform or non-uniform. A uniform discretization corresponds to the same spacing between each element. In FIG. 7, the point denoted Γ(0) corresponds to the reflectivity of the antenna and the point denoted Γ(n) corresponds to the reflectivity of the medium for the nth radiating element. In the case of FIG. 7, this reflectivity is equal to −1.

The length of the parameterized path $L_{\Gamma n}$ has the value:

$$L_{\Gamma n}=\int_0^{s_n}\|v(s)\|ds$$

$s_0$ is the initial value of the physical parameter or of all of the parameters when several are taken into account. It corresponds to the value of the parameter of the first radiating element, closest to the antenna.

$s_n$ is the final value of the physical parameter or of all of the parameters when several are taken into account. It corresponds to the value of the parameter of the last radiating element, closest to the medium.

v(s) is the derivative value of Γ(s). Its coordinates in the complex plane are:

$$\begin{cases} x'(s) \\ y'(s) \end{cases}$$

In a second step of the method according to the invention, the masking of the diffraction phenomena is optimized. It is necessary for the norm of the parametric speed denoted ||v(s)|| to be low at the start and at the end of the transition and great at the center. For this, it follows mathematical laws which make it possible to obtain this behavior. The parametric speed can take different values in the transition.

Figure 8:
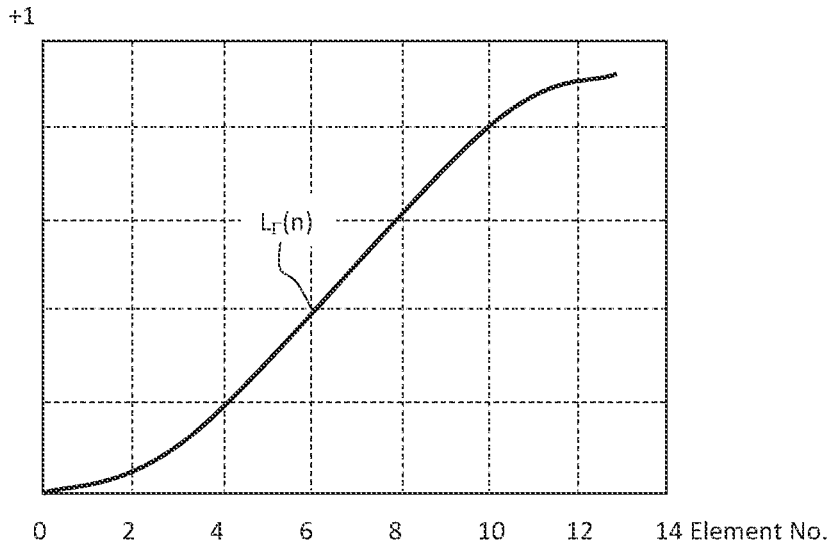
FIG. 8 represents the variation of the path representative of the variations of reflectivity as a function of successive radiating elements.
Figure 9:
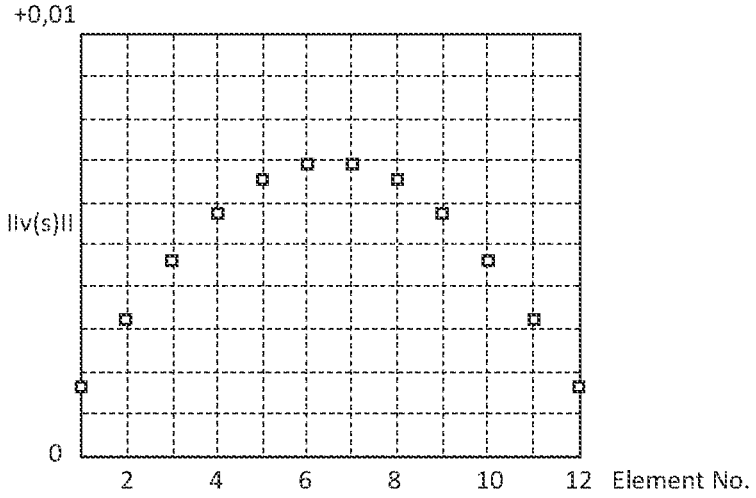
FIG. 9 represents the rate of variation of the reflectivity as a function of successive radiating elements.

FIG. 8 presents an example of the mathematical law describing the changes to the parameterized length $L_\Gamma$ as a function of the position of the radiating element i. As an indication, the number of radiating elements is 12 in FIGS. 8 and 9. The curve of FIG. 8 shows low variations at the start and at the end so as to obtain low parametric speeds at the ends. The norm of the parametric speed is represented discretely in FIG. 9. It is expressed also as a function of the radiating element i.

Once the law of $L_\Gamma$ is defined, the next step of the method consists in working back to the values of the parameter or to all of the parameters associated with each length value of the parameterized curve.

This determination can be made in different ways: analytically, if there is a transition formula, by means of charts or tabulated values.

Figure 10:
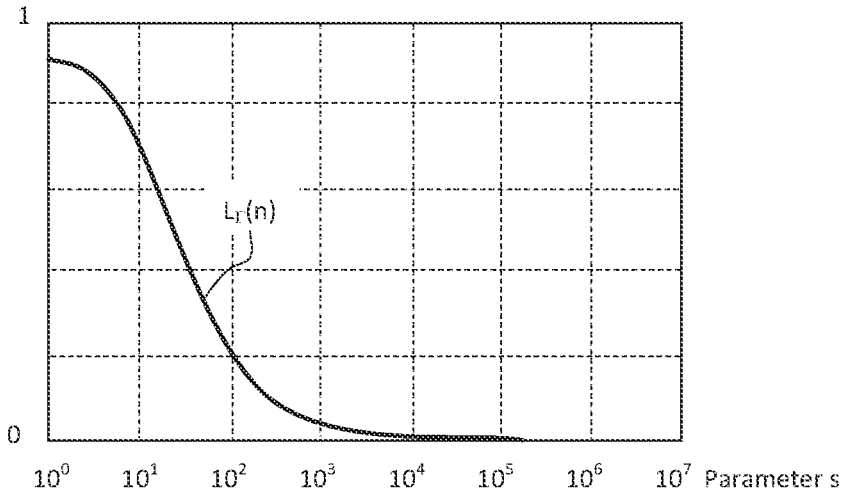
FIG. 10 represents the variation of the reflectivity coefficient as a function of the variation of the dependency parameter.

FIGS. 10 and 11 represent this step of determination of the physical dimensions associated with each element of the transition.

FIG. 10 represents the variation of the length of the path $L_{\Gamma n}$ as a function of the maximum value of the parameter s. This figure is represented in a semi-logarithmic reference frame, the parameter s varying according to a logarithmic law. For a given maximum parameter value, the value of the corresponding path is therefore deduced therefrom.

FIG. 11 represents, for a determined maximum parameter value, the value of this parameter for each radiating element. For example, in FIG. 11, the maximum variation of s is 2000 for the first element, 500 for the second, 200 for the third, and so on for the subsequent elements.

Once this step is finished, the reflectivity of all of the elements of the transition can be represented in the complex plane to check the correct distribution of the points on the accessible path determined initially.

As a nonlimiting example, the method is implemented in the case of the incorporation of an array antenna composed of waveguide apertures in a metallic medium. FIG. 12 represents, by a top view, the antenna A at its separation with the medium M. The apertures of the radiating elements ER are all identical, of square form and of side a. They are arranged regularly.

In the frequency band of interest, the waveguides are said to be "under cutoff", which is reflected by a total reflectivity of the guides, without in any way having a phase shift of 180° like the perfect metallic plane. That is reflected by an electrical discontinuity between the array of guides and a plate of metal causing diffraction phenomena. FIG. 13 represents the variation of the reflectivity coefficient between the antenna and its medium in the complex plane. In FIG. 13, the point denoted Γ(0) corresponds to the reflectivity of the antenna and the point denoted Γ(n) corresponds to the reflectivity of the medium for the nth radiating element. In the case of FIG. 13, this reflectivity is equal to −1.

The method according to the invention consists in determining a transition zone separating the antenna from its medium so that the issues of spurious reflectivity are highly attenuated.

Figure 14:
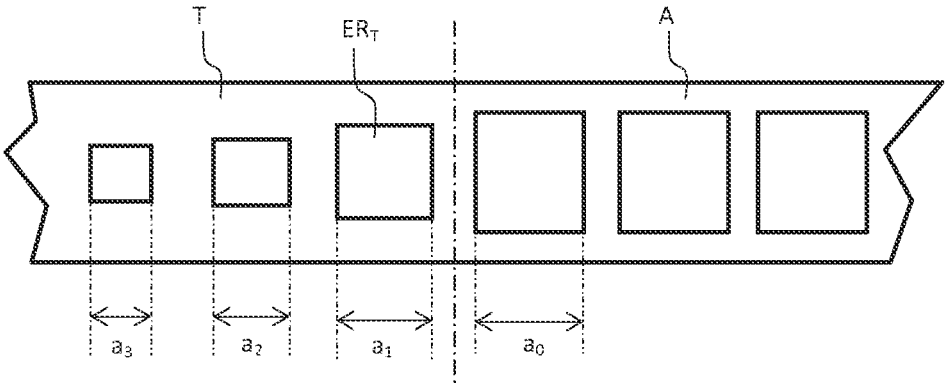
FIG. 14 represents a top view of a part of an array of radiating elements in an embodiment according to the invention.

The radiating elements of this transition zone are of the same nature as those of the antenna but of smaller dimensions. The parameter retained to make the reflectivity of the radiating element vary is therefore this dimension. FIG. 14 represents, by a top view, the antenna at its separation with the medium with the radiating elements $ER_T$ of the transition zone. The dimension $a_1$ of the first element of the transition zone is therefore less than $a_0$, the last element of the antenna, the dimension $a_2$ of the second element of the transition zone is therefore less than $a_0$ and so on for the subsequent elements.

Figure 15:
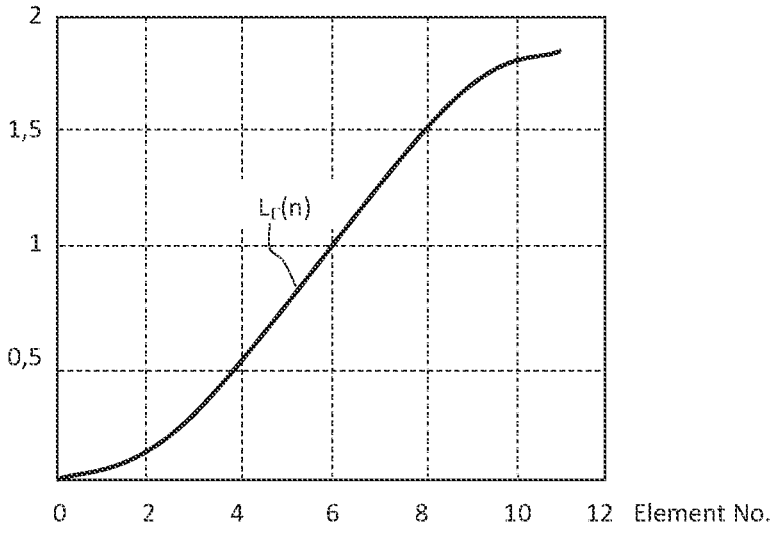
FIG. 15 represents the variation of the path representative of the variations of reflectivity as a function of the successive radiating elements of FIG. 14.

FIG. 15 represents the variation of the path representative of the variations of reflectivity as a function of the successive radiating elements of FIG. 14.

Figure 16:
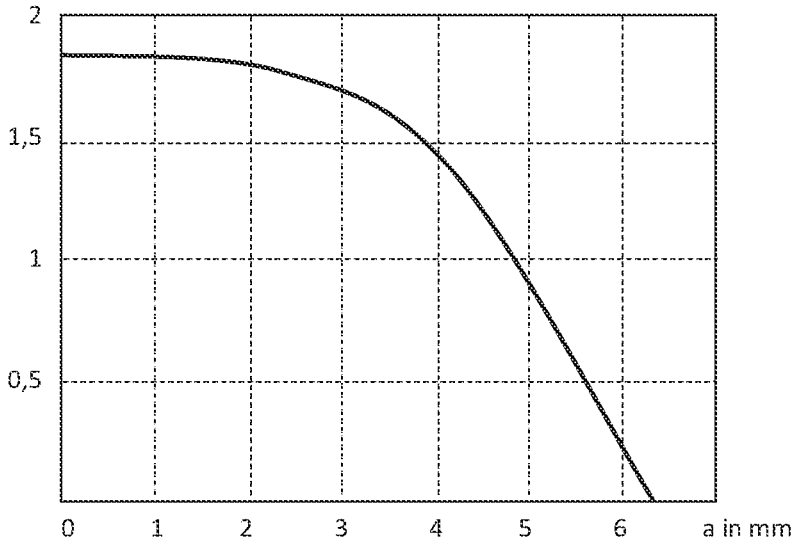
FIG. 16 represents the variation of the path representative of the variations of reflectivity of FIG. 15 as a function of the dependency parameter.

FIG. 16 represents the variation of the path representative of the variations of reflectivity as a function of the dependency parameter. In this figure, the parameter a varies between 0 and 7 millimeters.

Figure 17:
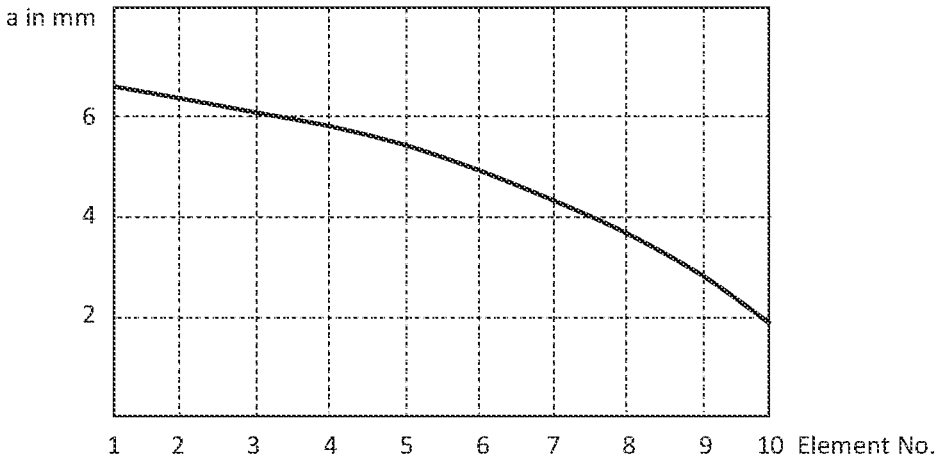
FIG. 17 represents the value of the dependency parameter of FIG. 16 as a function of the radiating element.

FIG. 17 represents the value of the dependency parameter as a function of the radiating element.

Figure 18:
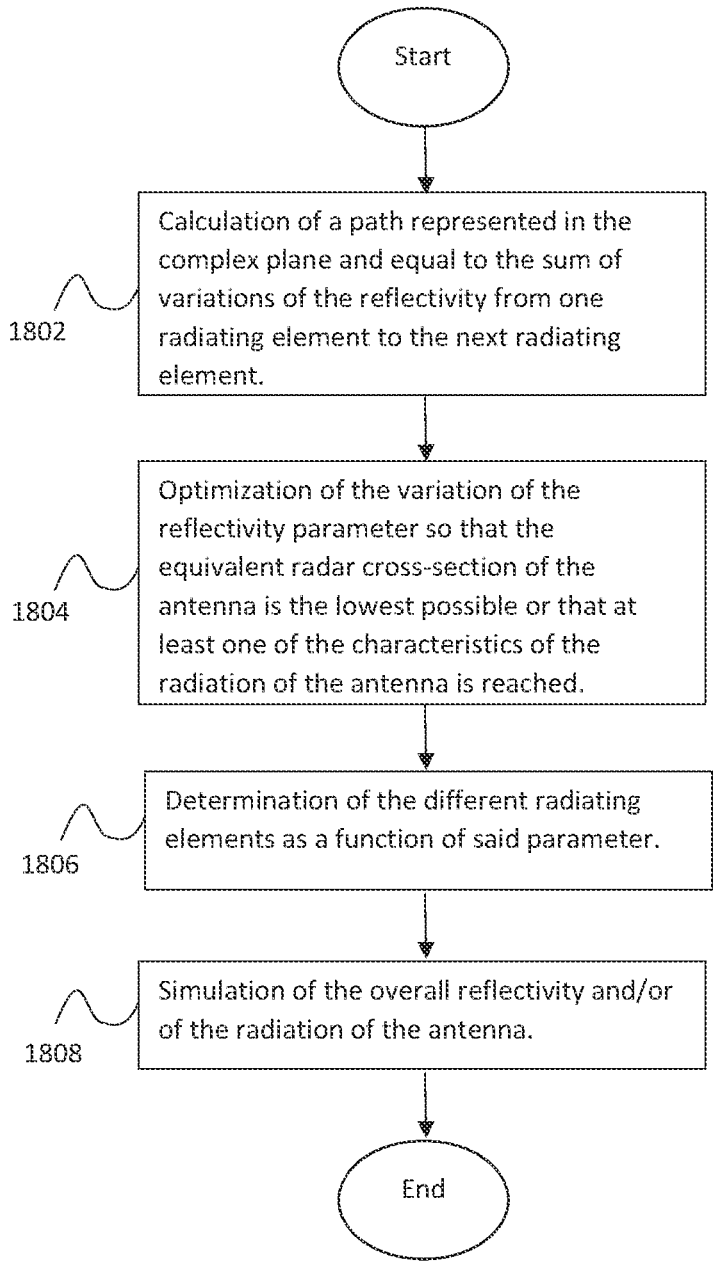
FIG. 18 represents a method according to an embodiment.

FIG. 18 represents a method. At block 1802, there is a calculation of a path represented in the complex plane and equal to the sum of variations of the reflectivity from one radiating element to the next radiating element. At block 1804, there is an optimization of the variation of the reflectivity parameter so that the equivalent radar cross-section of the antenna is the lowest possible or that at least one of the characteristics of the radiation of the antenna is reached. At block 1806, there is a determination of the different radiating elements as a function of said parameter. At block 1808, there is a simulation of the overall reflectivity and/or of the radiation of the antenna.

The simulations of the electromagnetic signature levels with or without said transition zone as defined previously shows a gain of approximately 30 dB over several frequency octaves, regardless of the polarization of the wave. This gain is all the greater when the incidence approaches grazing incidence.

The method according to the invention makes it possible to obtain substantial attenuations of the spurious effects at the cost of reduced additional complexity. In the preceding exemplary embodiment, the radiating elements of the transition zone are, in fact, of the same nature as those of the antenna and pose no production problem.

In the preceding example, the variable parameter is the size of the radiating elements. There are however many ways in which to modify the reflectivity parameter.

Thus, the radiating element being metallic, the parameter can be a geometrical parameter of the radiating element so that the radiating elements have different metallic surfaces.

The parameter can be a geometrical parameter of the radiating elements so that the radiating elements have different resistive surfaces.

The parameter can be a physical characteristic of a substrate or of a superstrate constituting the radiating elements. This physical characteristic can be the relative permittivity or the permeability of said substrate or of said superstrate.

The radiating elements can comprise a plurality of sheets of metallic or resistive patterns, the parameter being the quantity or the arrangement of said sheets present in the radiating elements.

Finally, the radiating elements can comprise metamaterials, the parameter being the quantity of metamaterials present in the radiating elements. The term metamaterial denotes an artificial composite material which has electromagnetic properties different from those of the natural materials. These metamaterials are composed of periodic, dielectric or metallic structures depending on the properties sought.

The invention claimed is:

1. A method for incorporating an array antenna (A) in a medium (M), said array antenna comprising a plurality of radiating elements ($ER_T$) ensuring a progressive transition of reflectivity between the array antenna and the medium, reflectivity of each radiating element depending on at least one parameter, the reflectivity being represented by a complex number, said at least one parameter varying from one radiating element to the next, wherein the method comprises the following steps:

Step 1: calculation of a path represented in the complex plane and equal to the sum of the variations of the reflectivity from one radiating element to the next radiating element;

Step 2: optimization of the variation of said at least one parameter along said path calculated in the complex plane so that the equivalent radar cross-section of the array antenna is the lowest possible or that at least one characteristic of the radiation of the array antenna is reached;

Step 3: determination of the different radiating elements as a function of said at least one parameter;

Step 4: simulation of the overall reflectivity and/or of the radiation of the array antenna.

2. The method for incorporating an array antenna as claimed in claim 1, characterized in that the rate of variation of said at least one parameter is minimal between the first radiating element and the next radiating element, minimal between the last radiating element and the preceding radiating element and maximal between the two radiating elements farthest away from the first radiating element and from the last radiating element.

3. The method for incorporating an array antenna as claimed in claim 1, characterized in that said complex number representing the reflectivity comprises a real part and an imaginary part and in that the variation of the reflectivity between two radiating elements is equal to the modulus of the variations of the real and imaginary parts of the reflectivity of said radiating elements.

4. The method for incorporating an array antenna as claimed in claim 1, characterized in that, the radiating elements being organized in an array, said at least one parameter is the pitch of the array in one direction of the space or two directions of the space.

5. The method for incorporating an array antenna as claimed in claim 1, characterized in that, the radiating elements being metallic, said at least one parameter is a geometrical parameter of the radiating elements so that the radiating elements have different metallic surfaces.

6. The method for incorporating an array antenna as claimed in claim 1, characterized in that said at least one parameter is a geometrical parameter of the radiating elements so that the radiating elements have different resistive surfaces.

7. The method for incorporating an array antenna as claimed in claim 1, characterized in that said at least one parameter is a physical characteristic of a constituting element constituting the radiating elements, said constituting element being a substrate.

8. The method for incorporating an array antenna as claimed in claim 1, characterized in that said at least one parameter is a physical characteristic of a constituting element constituting the radiating elements, said constituting element being a superstrate.

9. The method for incorporating an array antenna as claimed in claim 7, characterized in that the physical characteristic is the relative permittivity of said constituting element.

10. The method for incorporating an array antenna as claimed in claim 7, characterized in that the physical characteristic is the permeability of said constituting element.

11. The method for incorporating an array antenna as claimed in claim 1, characterized in that, the radiating elements comprising a plurality of sheets of metallic patterns, said at least one parameter is the quantity or the arrangement of said sheets present in the radiating elements.

12. The method for incorporating an array antenna as claimed in claim 1, characterized in that, the radiating elements comprising a plurality of sheets of resistive patterns, said at least one parameter is the quantity or the arrangement of said sheets present in the radiating elements.

13. The method for incorporating an array antenna as claimed in claim 1, characterized in that, the radiating elements comprising metamaterials, said at least one parameter is the quantity of metamaterials present in the radiating elements.

14. An array antenna intended to be incorporated in a medium, said array antenna comprising a plurality of radiating elements ensuring a progressive transition of reflectivity between the array antenna and the medium, reflectivity of each radiating element depending on at least one parameter, the reflectivity being represented by a complex number, that wherein said at least one parameter varies from one radiating element to the next, the rate of variation defined by the derivative of the reflectivity in the complex plane with respect to said at least one parameter being minimal between the first radiating element and the next radiating element, minimal between the last radiating element and the preceding radiating element and maximal between the two radiating elements furthest away from the first radiating element and from the last radiating element.

15. The array antenna as claimed in claim 14, characterized in that said at least one parameter is the pitch of the array in one direction of the space or in two directions of the space.

16. The array antenna as claimed in claim 14, characterized in that, the radiating elements being metallic, said at least one parameter is a geometrical parameter of the radiating elements so that the radiating elements have different metallic surfaces.

17. The array antenna as claimed in claim 14, characterized in that said at least one parameter is a geometrical parameter of the radiating elements so that the radiating elements have different resistive surfaces.

18. The array antenna as claimed in claim 14, characterized in that said at least one parameter is a physical characteristic of a constituting element constituting the radiating elements, said constituting element being a substrate.

19. The array antenna as claimed in claim 14, characterized in that said at least one parameter is a physical characteristic of a constituting element constituting the radiating elements, said constituting element being a superstrate.

20. The array antenna as claimed in claim 18, characterized in that the physical characteristic is the permittivity of said constituting element.

21. The array antenna as claimed in claim 18, characterized in that the physical characteristic is the permeability of said constituting element.

22. The array antenna as claimed in claim 14, characterized in that, the radiating elements comprising a plurality of sheets of metallic patterns, said at least one parameter is the quantity or the arrangement of said sheets present in the radiating elements.

23. The array antenna as claimed in claim 14, characterized in that, the radiating elements comprising a plurality of sheets of resistance patterns, said at least one parameter is the quantity or the arrangement of said sheets present in the radiating elements.

24. The array antenna as claimed in claim 14, characterized in that, the radiating elements comprising metamaterials, said at least one parameter is the quantity of metamaterials present in the radiating elements.

* * * * *